United States Patent [19]

Bluemel et al.

[11] 3,951,901

[45] Apr. 20, 1976

[54] PROCESS FOR THE PRODUCTION OF HOMOGENEOUS POLYOLEFIN RUBBER-OIL MIXTURES

[75] Inventors: Harald Bluemel; Georg Schleich, both of Marl, Germany

[73] Assignee: Chemische Werke Huls Aktiengesellschaft, Marl, Germany

[22] Filed: Feb. 21, 1974

[21] Appl. No.: 444,282

[30] Foreign Application Priority Data

Feb. 23, 1973 Germany ..... 2309039

[52] U.S. Cl. ..... 260/33.6 AQ

[51] Int. Cl.[2] ..... C08K 5/01

[58] Field of Search ..... 260/33.6 AQ

[56] References Cited

UNITED STATES PATENTS

| | | | |
|---|---|---|---|
| 3,676,387 | 7/1972 | Lindlof | 260/33.6 AQ |
| 3,679,380 | 7/1972 | Biswell et al. | 260/33.6 AQ |
| 3,691,078 | 9/1972 | Johnston et al. | 252/59 |
| 3,794,611 | 2/1974 | Brice | 260/33.6 AQ |

*Primary Examiner*—Donald E. Czaja
*Assistant Examiner*—H. H. Fletcher
*Attorney, Agent, or Firm*—Millen, Raptes & White

[57] ABSTRACT

A process for preparing a homogeneous liquid mixture consisting essentially of a normally solid polyolefin rubber copolymer of at least two different monoolefinically unsaturated hydrocarbons of 2–8 carbon atoms or of at least two different monoolefinically unsaturated hydrocarbons of 2–8 carbon atoms and at least one copolymerizable unconjugated diene hydrocarbon of 6–16 carbon atoms and at least an equal amount by weight of an extending oil having a viscosity of 50–5000 centistokes and a specific gravity of 0.84 – 0.98, which comprises:

a. adding the copolymer to said extending oil at a temperature of 80° – 230°C; and b. admixing the copolymer with the hot extending oil at an agitation speed of 1–500 cm/sec and a shear velocity of 0.5 – 100 $sec^{-1}$ for a period of time sufficient to form said homogeneous liquid mixture substantially free of particulate copolymer.

5 Claims, No Drawings

PROCESS FOR THE PRODUCTION OF HOMOGENEOUS POLYOLEFIN RUBBER-OIL MIXTURES

BACKGROUND OF THE INVENTION

The present invention relates to a process for the production of homogeneous polyolefin rubber-oil viscous liquid mixtures containing an equal or predominant amount by weight of oil.

It has long been known to extend elastomers with oil for economical and technical reasons. One common conventional process involves adding oil to a solution or dispersion of the rubber prior to precipitation, and precipitating the oil together with the rubber in the manufacturing plant. See S. Bostroem, "Kautschuk-Handbuch" (Rubber Handbook), Berliner Union/-Stuttgart, 1959, vol. 1, p. 362. This process is used only rarely, for reasons of expense and difficulties in the processing technique, in order to produce oil-extended rubbers having more than 100 parts by weight of oil per 100 parts by weight of rubber.

Another known process utilized by rubber processing companies is characterized by the production of rubber-oil batches shortly before or during the manufacturing of so-called rubber mixtures. These known mixtures contain, in addition to the rubber and/or oil, fillers, "Factice" substances, metallic oxides, fatty acids, coloring agents, vulcanizing agents, vulcanization accelerators, antiaging substances and/or stabilizers, waxes, and other recipe components known in the rubber industry. The oil is added to the rubber or rubber mixtures in these processes either with the aid of conventional mixing devices of the rubber industry, e.g., roll mills, internal mixers with and without a plunger, etc., or with more recently developed mixing units, e.g., continuously operating mixers described in S. Bostroem, "Kautschuk-Handbuch" Berliner Union/-Stuttgart, 1959, vol. 1, p. 362. The preparation of rubber-oil mixtures containing more than 100 parts by weight of oil per 100 parts by weight of rubber causes technical difficulties when such a process is employed unless unusually high doses of filler are employed and special mixing conditions are maintained, e.g., the premixing of a rubber-oil batch with a particularly low viscosity to facilitate the adsorption of larger amounts of oil, or the use of especially sealed mixing units.

It is known from German Unexamined Laid-Open Application DOS 1,814,842, to extend rubber copolymers of at least two different $\alpha$-olefins with up to 350 parts by weight of oil. According to this method, the rubber is allowed to stand in the oil for a period of time without substantial stirring, so that the oil can diffuse into the rubber. The production of highly oil-extended rubbers and/or of rubber-oil mixtures having a rubber-:oil ratio of at least 1:1 is possible according to this process only at a high cost in time and space. For reasons of economy and available space, especially in those cases where larger amounts of elastomer are to be extended with oil, this process is unsuitable.

British Patent 962,519, the contents of which are incorporated by reference herein, describes elastomeric hydrocarbon copolymers of at least one $\alpha$-monoolefin and at least one non-conjugated diene which are extended with specific petroleum oils to give normally solid, sulfur curable mixtures. The process of the present invention is not limited to the particular petroleum oils described therein and is used to prepare homogenous liquid compositions of high oil content which can be readily blended with either solid or liquid compositions.

Finally, U.S. Pat. No. 3,679,380 discloses the use of liquid ethylene-$\alpha$-olefin copolymers and/or of liquid ethylene- $\alpha$-olefin-diene terpolymers in the extremely low-molecular weight range (Mn <18,000) to improve various properties of mineral oils. However, these extremely low-molecular weight co- and/or terpolymers of ethylene possess uncommon properties with respect to Mooney viscosity and accordingly they require a special manufacturing process for each case.

Because of the advantageous properties of elastomeric copolymers of $\alpha$-olefins optionally with non-conjugated dienes, it would be highly desirable to expand the scope of possible applications by providing a technically acceptable method for preparing highly oil-extended, homogeneous copolymer compositions.

In view of the above-discussed processes of the current state of the art, there is a genuine need for a simple and economical process for the manufacture of rubber-oil mixtures, specifically of polyolefin rubber-oil mixtures, wherein the rubber to oil ratio is at least 1:1 and wherein rubbers in the usual plasticity and/or viscosity range, i.e., having a viscosity of 5 to 150 $ML_{1+4}$ (100°C) can be employed.

OBJECTS OF THE INVENTION

Accordingly, it is a general object of the present invention to provide an economical process for preparing homogeneous polyolefin rubber-oil mixtures containing at least as much oil by weight as polyolefin rubber.

Another object of this invention is to provide a process for rapidly preparing solutions of polyolefin rubber in extending oils commonly employed in the rubber processing industry.

A further object of this invention is to provide a process for preparing highly extended, liquid homogeneous polyolefin rubber-oil mixtures containing 1–20, preferably 4–8 times as much oil as rubber.

A more particular object of this invention is to provide a process for preparing the above mixtures with ethylene-propylene-unconjugated diene rubbers.

Upon further study of the specification and appended claims, further objects and advantages of this invention will become apparent to those skilled in the art.

SUMMARY OF THE INVENTION

Briefly, the above and other objects are attained in one aspect of the present invention by providing a process for preparing a homogeneous liquid mixture consisting essentially of a normally solid polyolefin rubber copolymer of at least two different monoolefinically unsaturated hydrocarbons of 2–8 carbon atoms or of at least two different monoolefinically unsaturated hydrocarbons of 2–8 carbon atoms and at least one copolymerizable unconjugated diene hydrocarbon of 6–16 carbon atoms and at least an equal amount by weight of an extending oil having a viscosity of 50–5000 centistokes and a specific gravity of 0.84 – 0.98, which comprises:

a. adding the copolymer to said extending oil at a temperature of 80°– 230°C; and b. admixing the copolymer with the hot extending oil at an agitation speed of 1–500 cm/sec and a shear velocity of 0.5 – 100 $sec^{-1}$ for a period of time sufficient to form said homogeneous liquid mixture substantially free of particulate copolymer.

DETAILED DISCUSSION

It has now been found that homogeneous polyolefin rubber-oil mixtures containing equal or predominant amounts by weight of oil can be produced by mixing saturated or unsaturated polyolefin rubbers at temperatures of between 80° and 270° under agitation with at least the same amount by weight of oil at agitating speeds of between 1 and 500 cm/sec and at shear velocities of between 0.5 and 100 $sec^{-1}$. As used herein, the term "agitating speed" refers to the circumference speed of the agitation device.

Saturated and unsaturated polyolefin rubbers in the scope of this invention are understood to mean solid elastomeric polymer products manufactured from ethylene, one or more $\alpha$-olefins of 3–8 carbon atoms, and optionally one or more non-conjugated multiple olefins with the aid of Ziegler-Natta catalysts, which can additionally contain activators and modifiers, in a solution or dispersion at temperatures of −30°C to +100°C, e.g.., in accordance with DOS 1,570,352; 1,595,447 and 1,720,450 or U.S. Patents 2,933,480 and 3,000,866, and which are normally solid and possess an average molecular weight (Mn) of >20,000, generally less than $400.10^3$ and preferably $25 - 100.10^3$ as determined by osmometric method.

Preferred are saturated polyolefin rubbers comprising 15–90% by weight, preferably 30–65% by weight, of ethylene and 85–10% by weight, preferably 70–35% by weight, of propylene and/or butene-1; and unsaturated polyolefin rubbers comprising, in addition to ethylene and propylene and/or butene-1, a nonconjugated multiple olefin within the limits indicated in connection with the saturated polyolefin rubbers and in such an amount that 0.5 – 30 double bonds per 1000 carbon atoms are present in the rubbers. Especially preferred multiple olefins are cis- and trans-1,4-hexadiene, dicyclopentadiene, methylene-, ethylidene-, and propenylnorbornene.

The polyolefin rubers employed generally have a viscosity of 5 – 250 Mooney units ($ML_{1+4}$ at 100°C), preferably about 30 – 180 and especially 35 – 100.

In both the saturated polyolefin rubbers and the unsaturated polyolefin rubbers, the monomers can be present in a random, statistically irregular form, as well as in longer block sequences.

In the process of this invention, suitable oils are petroleum refinery mineral oils as well as synthetic products, e.g., the last runnings of tetrapropylene benzene. The oils generally have viscosities of between 50 and 5000 centistokes, preferably between 200 and 3000 and especially between 250 and 2000 centistokes at 20°C, a density or specific gravity of between 0.84 and 0.98 g/$cm^3$, and boiling points of 120° to 370°C at 5 Torr, preferably 200° to 300°C at 5 Torr. With respect to the distribution of the carbon atoms, these oils can be predominantly aromatic, naphthenic or paraffinic oils. The oils have flash points safely above mixing temperatures employed, e.g., at least 80°C and preferably at least 160°C. Suitable such oils are well known in the art.

The production of the homogeneous polyolefin rubberoil mixtures according to the present invention is generally accomplished at temperatures of between 80° and 230°C, preferably between 160° and 210°C. Generally, the oil is first charged into a cylindrical agitated vessel and then heated to the desired temperature.

Thereafter, with the aid of an agitator, generally a rotary agitator and preferably a turbine, paddle propeller or a vane-type agitator, the desired agitation speed is set between 1 and 500 cm/sec, preferably between 5 and 100 cm/sec and the desired shear velocity is adjusted to be between 0.5 and 100 $sec^{-1}$, preferably between 1 and 50 $sec^{-1}$. The saturated and/or unsaturated polyolefin rubber is then introduced into the heated, mechanically agitated oil in such an amount that the resultant polyolefin rubber-oil mixture will contain the desired proportions, and the mixture is agitated with shearing until it is homogenized to a single viscous liquid phase. Mixtures having a polyolefin rubber to oil weight ratio up to 1:20 , preferably 1: 1 to 1: 10 and especially of about 1:3 to 1:6 are easily prepared in accordance with the process of this invention. In order to keep the time for producing these homogeneous mixtures at a minimum, it is advisable to coarsely comminute the polyolefin rubber before it is introduced into the oil. Loose, freely movable polyolefin rubber crumbs having a density of 0.1 – 0.4 g/$cm^3$ are preferably utilized in the process of this invention.

The use of elastomeric copolymers of $\alpha$-monoolefins and non-conjugated dienes to impart ozone resistance to diene rubbers is known, e.g., see U.S. Pat. No. 3,224,985. The homogenized polyolefin rubber-oil liquids prepared according to the process of the present invention can be used, inter alia, as additives to lubricating oils, as plasticizers containing ozone-resistant polymers, or as additives to binders for compositions containing mineral fillers in the building industry.

The process of this invention thus makes it possible to produce, in a simple and economical manner, homogeneous polyolefin rubber-oil mixtures which contain equal or predominant amounts by weight of oil. This was particularly surprising since the conventional types of rubber, such as natural rubber, polybutadiene, SBR, polychloroprene and nitrile rubber cannot be homogenized within a similarly short period of time as in the claimed process as shown by comparative Example 12.

The homogeneous liquid mixtures prepared according to the process of this invention are substantially free of particulate copolymer, i.e.., less than 5 % and preferably less than 1 % of the copolymer remains in the solid state.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever. In the following Examples, the temperatures are set forth uncorrected in degrees Celsius; unless otherwise indicated, all parts and percentages are by weight. The values obtained in elemental analyses are within commonly accepted limits of error.

EXAMPLE 1

In a cylindrical agitator-equipped vessel having a capacity of about 1 liter and a diameter of 11.7 cm, 500 g of a mineral oil having a viscosity of 2880 cs, a density of 0.98 g/$cm^3$ and a carbon atom distribution of 18% aromatic-, 41% naphthenic- and 41% paraffinic-bound carbon atoms [determined according to the Sun-Oil method, H.A. Munderloh, "Kautschuk, Gummi und Asbest" (Natural Rubber, Synthetic Rubber, and Asbestos) 12 (9): 246 ff. (1959)] is heated to a temperature of between 180° and 190°C. With the use of a turbine agitator having a diameter of 4.4 cm at 50 r.p.m., corresponding to an agitating speed of miximally 11.5 cm/sec and with a shear velocity of 3.1 $sec^{-1}$, 100 g of coarsely comminuted EPDM rubber is added to the heated oil during about 1 minute. The EPDM rubber has the following polymer data: $ML_{1+4}$ (100° C): 69; $C_3H_6$ proportion: 50% by weight; ternary component: ethylidenenorbornene; unsaturation: 8 double bonds per 1000 carbon atoms. After about 40 minutes, a completely homogeneous rubber-oil mixture has been produced in the form of a highly viscous liquid.

EXAMPLE 2

Following the procedure of Example 1 but using an agitating speed of maximally 300 cm/sec, corresponding to a speed of rotation of 1300 r.p.m. and a shear velocity of 80 $sec^{-1}$, 100 g of the coarsely comminuted EPDM rubber is added to the oil within about 1 minute. After 25 minutes, an entirely homogeneous rubber-oil mixture has been produced in the form of a highly viscous liquid.

EXAMPLE 3

Following the procedure of Example 1 but using an agitating speed of maximally 67 cm/sec, corresponding to a speed of rotation of 290 r.p.m., and at a shear velocity of 18.3 $sec^{-1}$, 100 g of the coarsely comminuted EPDM rubber is added to the oil. After 23 minutes, a completely homogeneous rubber-oil mixture has been formed as a highly viscous liquid.

EXAMPLE 4

Following the procedure of Example 1, the temperature of the heated oil is 100°C. The agitation and shear velocities are maximally 70 cm/sec, corresponding to 300 r.p.m., and 19.4 $sec^{-1}$, 100 g of the coarsely comminuted EPDM rubber is added to the oil. After 46 minutes, a completely homogeneous rubber-oil mixture has been produced in the form of a highly viscous liquid.

EXAMPLE 5

Following the procedure of Example 1, the turbine agitator used therein is replaced by a paddle agitator of the same diameter and the temperature of the heated oil is 210°C. The agitating and shear velocities are as set forth in Example 3. 100 g of the coarsely comminuted rubber is added to the oil within about 1 minute. After 19 minutes, an entirely homogeneous rubber-oil mixture has been formed as a highly viscous liquid.

EXAMPLE 6

Following the procedure of Example 1, the turbine agitator used therein is replaced by a propeller agitator of the same diameter. At an agitating speed of 85 cm/sec and a shear velocity of 23.3 $sec^{-1}$, 100 g of rubber is introduced. After 30 minutes, a homogeneous rubber-oil mixture has been formed.

EXAMPLE 7

Following the procedure of Example 1, the speed of rotation of the agitator is 370 r.p.m., corresponding to an agitating speed of maximally 85 cm/sec and a shear velocity of 23.3 $sec^{-1}$, 100 g of a coarsely comminuted EPDM rubber is added to 300 g of the mineral oil. The rubber has the following polymer characteristics: $ML_{1+4}$ (100°C): 72; $C_3H_6$ proportion: 49% by weight; ternary component: dicyclopentadiene; unsaturation: 7 double bonds per 1000 carbon atoms. After 45 minutes, an entirely homogeneous rubber-oil mixture has been formed.

EXAMPLE 8

Following the procedure of Example 1, the agitating and shear velocities are 11.5 cm/sec and 3.15 $sec^{-1}$, respectively. As the saturated polyolefin rubber, 100 g of an ethylene-propylene rubber is introduced having the following characteristic data: $ML_{1+4}$ (100°C): 51; $C_3H_6$ proportion: 49%. After about 40 minutes, an entirely homogeneous rubber-oil mixture has been formed.

EXAMPLE 9

Following the procedure of Example 1, the agitating and shear velocities are 85 cm/sec and 23.3 $sec^{-1}$, respecitvely. 100 g of a so-called sequence EPDM rubber in the form of loose crumbs is introduced into the oil. The EPDM rubber is containing a ternary monomer selected from the group consisting of 1,4-hexadiene, dicyclopentadiene, methylene-, ethylidene- and propenyl-norbornene. The rubber has a $ML_{1+4}$ (100 °C) of 5 to 250, a $C_3H_6$ content of 10 – 85 % and a ternary monomer content producing 0,5 to 30 double bonds per 1000 C-atoms. The crumbs consist of strongly fissured, cylindrically formed strands of the polymer with a diameter of between 0.5 and 1.5 cm and a length of between 0.5 and 10 cm. After only 14 minutes, a completely homogeneous rubber-oil mixture has been produced.

EXAMPLE 10

Following the procedure of Example 1, the mineral oil utilized therein is replaced by one having the following characteristic data: viscosity (20°C): 4800 cs; density: 0.98 $g/cm^3$; carbon atom distribution: 37% aromatically, 28% naphthenically, and 35% paraffinically bound. 500 g of this oil is heated to 180°C. The agitating and shear velocities are 85 cm/sec and 23.3 $sec^{-1}$, respectively. 28 minutes after the introduction of the rubber, a homogeneous rubber-oil mixture has been formed.

EXAMPLE 11

Following the procedure of Example 1, a mineral oil was employed having the following characteristic data: viscosity (20°C):330 cs; density: 0.87 ($g/cm^3$); carbon atom distribution: 4% aromatically, 27% naphthenically and 69% paraffinically bound. 500 g of this oil is heated to 180°C. The agitating and shear velocities are 11.5 cm/sec and 3.15 $sec^{-1}$, respectively. A homogeneous rubber-oil mixture has been produced 35 minutes after the introduction of the rubber.

EXAMPLE 12

(Comparative Example)

Following the procedure of Example 1, in all other aspects, within 1 minute 100 g of a styrene-butadiene rubber (SBR 1500) is added thereto. After 120 minutes, no homogeneous rubber-oil mixture has formed; rather, swollen pieces of the rubber are floating in the hot oil without being dissolved. Similar observations have been made with the use of corresponding quantities of polybutadiene and nitrile rubber.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for preparing a homogeneous liquid mixture consisting essentially of i) a normally solid polyolefin rubber copolymer of 30–65% by weight ethylene and correspondingly 70–35% by weight of at least one monoolefinically unsaturated hydrocarbon of 3–8 carbon atoms, optionally further including at least one copolymerizable unconjugated diene hydrocarbon of 6–16 carbon atoms in an amount which provides 0.5–30 olefinic double bonds per 100 carbon atoms in the copolymer, sad polyolefin rubber copolymer having a molecular weight ($M_n$) of 25,000–100,000 as determined by the osmometric method and a Mooney viscosity $ML_{1+4}$ at 100° C. of 30–180, dissolved in ii) 3–6 parts by weight, per part by weight of the copolymer, of an extending oil having a viscosity of 50–5000 centistokes at 20° C., a specific gravity of 0.84–0.98 and a boiling point of 120°–370° C. at 5 Torr, which comprises:

a. adding the polyolefin rubber in the form of loose, freely movable crumbs having a density of 0.1–0.4 g/cm$^3$ to said extending oil at a temperature of 160–210° C; and b. admixing the polyolefin rubber crumbs with the hot extending oil at an agitation speed of 5–100 cm/sec. and a shear velocity of 1–50 sec.$^{-1}$ for a period of time less than about 45 minutes but which time is sufficient to form a homogeneous liquid mixture wherein less than 1% by weight of the polyolefin rubber remains in the solid state.

2. A process according to claim 1, wherein the polyolefin rubber is an ethylene-propylene rubber.

3. A process according to claim 1, wherein the polyolefin rubber is an unconjugated diene rubber.

4. A process according to claim 3, wherein the unconjugated diene is selected from the group consisting of 1,4-hexadiene, dicyclopentadiene, methylenenorbornene, ethylidenenorbornene and propenylnorbornene.

5. A process according to claim 1, wherein the extending oil has a viscosity of 200–3000 centistokes at 20° C.

* * * * *